US009167926B1

(12) United States Patent
Helmuth et al.

(10) Patent No.: US 9,167,926 B1
(45) Date of Patent: Oct. 27, 2015

(54) PIZZA BOX HAVING FOLDABLE LID

(71) Applicants: Dennis Helmuth, Wooster, OH (US); Kathryn Helmuth, Wooster, OH (US)

(72) Inventors: Dennis Helmuth, Wooster, OH (US); Kathryn Helmuth, Wooster, OH (US)

( * ) Notice: Subject to any disclaimer, the term of this patent is extended or adjusted under 35 U.S.C. 154(b) by 0 days.

(21) Appl. No.: 14/464,775

(22) Filed: Aug. 21, 2014

(51) Int. Cl.

| | |
|---|---|
| ***B65D 5/00*** | (2006.01) |
| ***B65D 43/00*** | (2006.01) |
| ***A47G 19/03*** | (2006.01) |
| ***B65D 85/36*** | (2006.01) |

(52) U.S. Cl.
CPC ..... *A47G 19/03* (2013.01); *B65D 85/36* (2013.01); *B65D 2585/366* (2013.01)

(58) Field of Classification Search
CPC ... A47G 19/03; B65D 85/36; B65D 2585/366
USPC ..... 229/902, 125, 906, 915, 126, 131.1, 229/117.15; D9/462; 206/509
See application file for complete search history.

(56) References Cited

U.S. PATENT DOCUMENTS

| | | | | |
|---|---|---|---|---|
| D274,889 | S | 7/1984 | Sullivan | |
| 5,056,710 | A | 10/1991 | Ritter | |
| D420,583 | S | 2/2000 | Cooper, Jr. | |
| 6,386,441 | B2 | 5/2002 | Philips | |
| 7,380,702 | B2 | 6/2008 | Oddo | |
| 7,628,311 | B2 | 12/2009 | Kuhn et al. | |
| 7,665,654 | B2 * | 2/2010 | McLeod | 229/143 |
| 8,770,466 | B1 * | 7/2014 | Terlesky et al. | 229/120.13 |
| 2004/0226989 | A1 * | 11/2004 | Cook et al. | 229/114 |
| 2006/0186186 | A1 | 8/2006 | Kuhn et al. | |
| 2007/0187473 | A1 * | 8/2007 | Oliveira | 229/169 |
| 2012/0080510 | A1 * | 4/2012 | Seliger et al. | 229/117.16 |

OTHER PUBLICATIONS

First pizza box having a handle built into the lid. See attached Table of Internet References including hyperlinks. http://togoprinting.en.made-in-china.com/product/FqmENnTCgsRf/China-Pizza-Box-with-Handle.html.
Second pizza box having a handle built into the lid. See attached Table of Internet References including hyperlinks. http://www.pack-usa.net/special%20shape%20pizza%20bx%20handle.jpg.
Third pizza box having handle built into lid. See attached Table of Internet References including hyperlinks. http://4.bp.blogspot.com/-Xx_HPaN6JEE/UTBO3s7VRSI/AAAAAAAACJw/6rQ3Rcd66sA/s1600/IMG_9386.JPG.
Pizza box having a lid that folds under the box to form a stand. See attached Table of Internet References including hyperlinks. http://minorthoughts.com/economics/an-evolution-of-innovative-technologically-advanced-pizza.

* cited by examiner

*Primary Examiner* — Christopher Demeree
(74) *Attorney, Agent, or Firm* — Dominic Frisina

(57) ABSTRACT

Embodiments may comprise a food container. Food containers according to embodiments of the invention may include at least three sidewalls each adjoining an edge of a base wall bounded by at least three edges. A food container may further include at least one lid comprising at least one leaf, wherein the leaf is adapted to be fixed in an open configuration and function as a handle while in the open configuration.

10 Claims, 8 Drawing Sheets

PIZZA BOX HAVING FOLDABLE LID

I. BACKGROUND OF THE INVENTION

A. Field of Invention

Embodiments generally relate to devices and methods for packaging, delivering, and serving foods.

B. Description of the Related Art

A number of disposable food containers are known in the art for packaging delivery foods such as pizza. With specific regard to pizza, it is well known to use boxes having a top-opening lid. Such boxes are typically suitable for delivery of a pizza product and also for serving the product. For instance, a user may place the pizza box on a countertop or tabletop with the lid open thus allowing persons to take a slice from the box. However, such boxes have certain shortcomings. Namely, the lid takes up a significant amount of space on the countertop or table top, effectively doubling the footprint of the pizza box which may make it difficult to serve more than one pizza at a time and may limit the amount of space available for diners, or for other uses. What is needed is a food container lid which does not increase the footprint of the container when the lid is open.

Some embodiments of the present invention may provide one or more benefits or advantages over the prior art.

II. SUMMARY OF THE INVENTION

Some embodiments may relate to a food container, comprising: at least three sidewalls each adjoining an edge of a base wall bounded by at least three edges; and at least one lid comprising at least one leaf, wherein the leaf is adapted to be fixed in an open configuration and function as a handle while in the open configuration.

Some embodiments may comprise four sidewalls, and a lid having two leaves attached to opposing sidewalls and adapted to substantially meet along a center line of the container when the lid is in a closed configuration.

According to some embodiments each of the two leaves are foldable along pre-formed center fold lines of the respective leaves, each leaf being divided into a pair of panels hingedly joined at the pre-formed fold lines.

Some embodiments further comprise a means for retaining each of the two leaves in a folded configuration, wherein the folded configuration corresponds to an open configuration of the container.

According to some embodiments the means for retaining is selected from one or more of a pop-out tab formable in a sidewall of the container, a slot formed in a sidewall of the container, or a tab formed on an edge of a leaf.

According to some embodiments each of the two leaves are rollable such that the container may be opened by rolling up the two leaves.

According to some embodiments the two rollable leaves are biased toward a rolled configuration.

According to some embodiments the at least three sidewalls comprise only three sidewalls, and the lid comprising at least one leaf comprises only one leaf.

According to some embodiments the leaf is foldable along a pre-formed fold line of the leaf, the pre-formed fold line dividing the leaf into two panels comprising one trapezoidal panel having its longest side adjoining a rear sidewall of the container, and a triangular panel adjoining the trapezoidal panel along the pre-formed fold line.

Some embodiments may comprise a slot formed into a rear sidewall of the container adapted to receive a tip of the triangular panel in a retained relation.

Some embodiments may relate to a food container, comprising: at least four sidewalls each adjoining an edge of a base wall bounded by a corresponding number of edges; and a lid comprising a pair of leaves adjoined to opposing sidewalls of the container and adapted to substantially meet along a center line of the container when the lid is in a closed configuration, wherein each of the two leaves are foldable along pre-formed center fold lines of the respective leaves, and wherein the leaves are retained in a folded configuration by one or more of a pop-out tab formable in a sidewall of the container, a slot formed in a sidewall of the container, or a tab formed on an edge of a leaf.

According to some embodiments the leaves are adapted to function as handles when the leaves are retained in the folded configuration.

Some embodiments may relate to a food container, comprising: three sidewalls each adjoining an edge of a base wall bounded by three edges; and a lid comprising a leaf, wherein the leaf is adapted to be fixed in an open configuration and function as a handle while in the open configuration.

According to some embodiments the leaf is foldable along a pre-formed fold line of the leaf, the pre-formed fold line dividing the leaf into two panels comprising one trapezoidal panel having its longest side adjoining a rear sidewall of the container, and a triangular panel adjoining the trapezoidal panel along the pre-formed fold line.

Some embodiments may further comprise a slot formed into a rear sidewall of the container adapted to receive a tip of the triangular panel in a retained relation.

Some embodiments may relate to a food container, comprising: at least three sidewalls each adjoining an edge of a base wall bounded by at least three edges, wherein the at least three sidewalls are constructed from a material selected from one or more of card board or corrugated card board; at least one lid comprising at least one leaf, wherein the leaf is adapted to be fixed in an open configuration and function as a handle while in the open configuration, wherein the at least one lid is constructed from a material selected from one or more of card board or corrugated card board; and a lining bonded to an interior surface of the at least three sidewalls and the at least one lid, the lining comprising one or more of a waterproofing layer, or an insulating layer.

Some embodiments may comprise four sidewalls, and further comprise a lid having two leaves attached to opposing sidewalls and adapted to substantially meet along a center line of the container when the lid is in a closed configuration.

According to some embodiments each of the two leaves are foldable along pre-formed center fold lines of the respective leaves, each leaf being divided into a pair of panels hingedly joined at the pre-formed fold lines.

Some embodiments may comprise a means for retaining each of the two leaves in a folded configuration, wherein the folded configuration corresponds to an open configuration of the container.

According to some embodiments the means for retaining is selected from one or more of a pop-out tab formable in a sidewall of the container, a slot formed in a sidewall of the container, or a tab formed on an edge of a leaf.

Other benefits and advantages will become apparent to those skilled in the art to which it pertains upon reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Embodiments may include a food container having a two-leaf foldable lid. The two leaves of the lid may meet along a center line of the box, and each of the two leaves may comprise two panels separated by a crease thereby allowing the panels to fold along a center line of the leaves. Embodiments may further include means for retaining the leaves in a folded configuration allowing the folded leaves to be used as handles for moving the food container.

Figure 1:
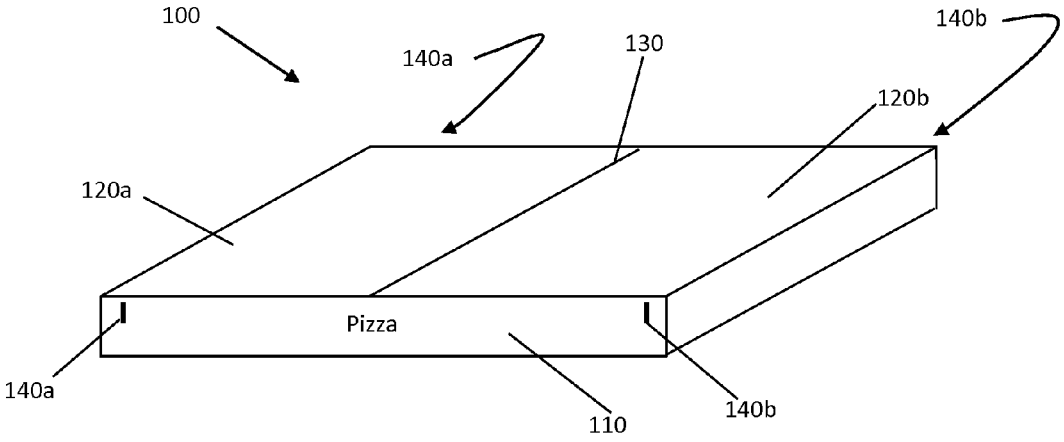
FIG. 1 is a perspective view of an embodiment in a closed configuration.

Referring now to the drawings wherein the showings are for purposes of illustrating embodiments of the invention only and not for purposes of limiting the same, FIG. 1 is a perspective view of an embodiment 100 comprising a pizza box. The embodiment 100 includes a first leaf 120*a* and a second leaf 120*b* which meet along a center line 130 of the box 100. The leaves 120*a*, 120*b* cooperate to enclose a box 110 which may contain a food product. Sides of the box 110 may include a first pair of slots 140*a*, and a second pair of slots 140*b*.

Figure 2:
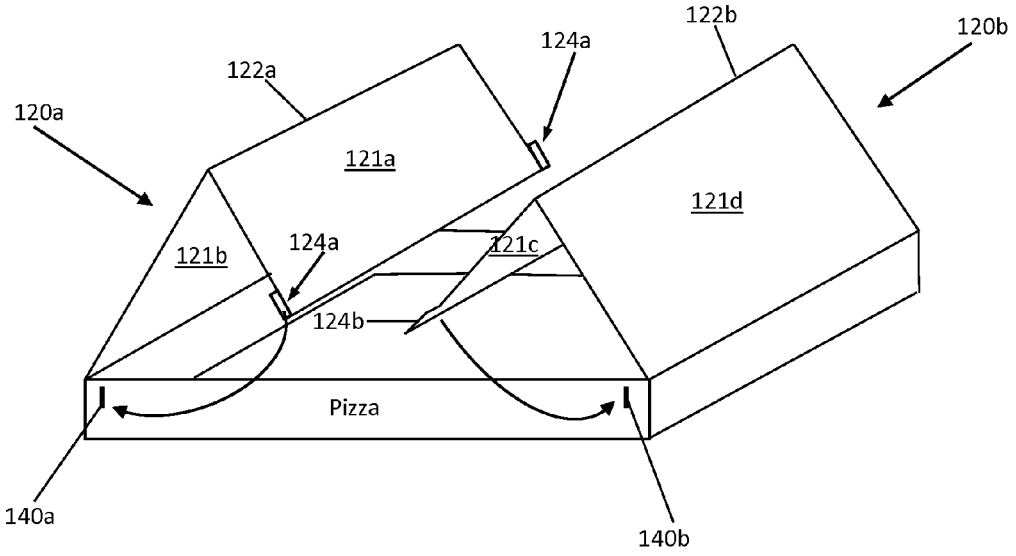
FIG. 2 is a perspective view of an embodiment in a semi-open configuration.

FIG. 2 illustrates that each leaf 120*a*, 120*b* is further divided into two pairs of panels, the first pair being 121*a* and 121*b*, and the second pair being 121*c* and 121*d*. The pairs of panels are foldable along a center line 122*a*, 122*b* of each leaf. Furthermore, each leaf 120*a*, 120*b* includes a pair of tabs. The first leaf 120*a* includes a pair of tabs 124*a*, and the second leaf 120*b*, includes a second pair of tabs 124*b*. As shown in FIG. 2, the pairs of slots 140*a*, 140*b* may cooperate with the pairs of tabs 124*a*, 124*b* to retain the leaves 120*a*, 120*b* in a folded configuration.

Figure 3:
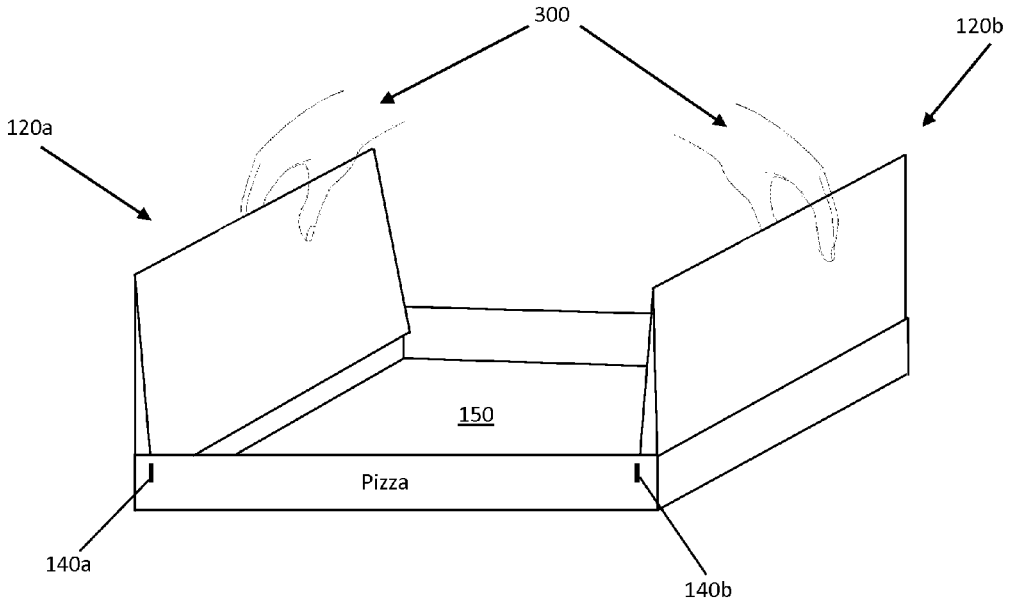
FIG. 3 is a perspective view of an embodiment in a fully open configuration.

FIG. 3 shows the box 100 with the leaves 120*a*, 120*b* in a fully folded configuration with the pairs of tabs 124*a*, 124*b* inserted into the pairs of slots 140*a*, 140*b*, and with the bottom 150 of the box 110 visible. A pair of hands 300 is also shown grasping the folded leaves 120*a*, 120*b* illustrating their function as handles.

Figure 4:
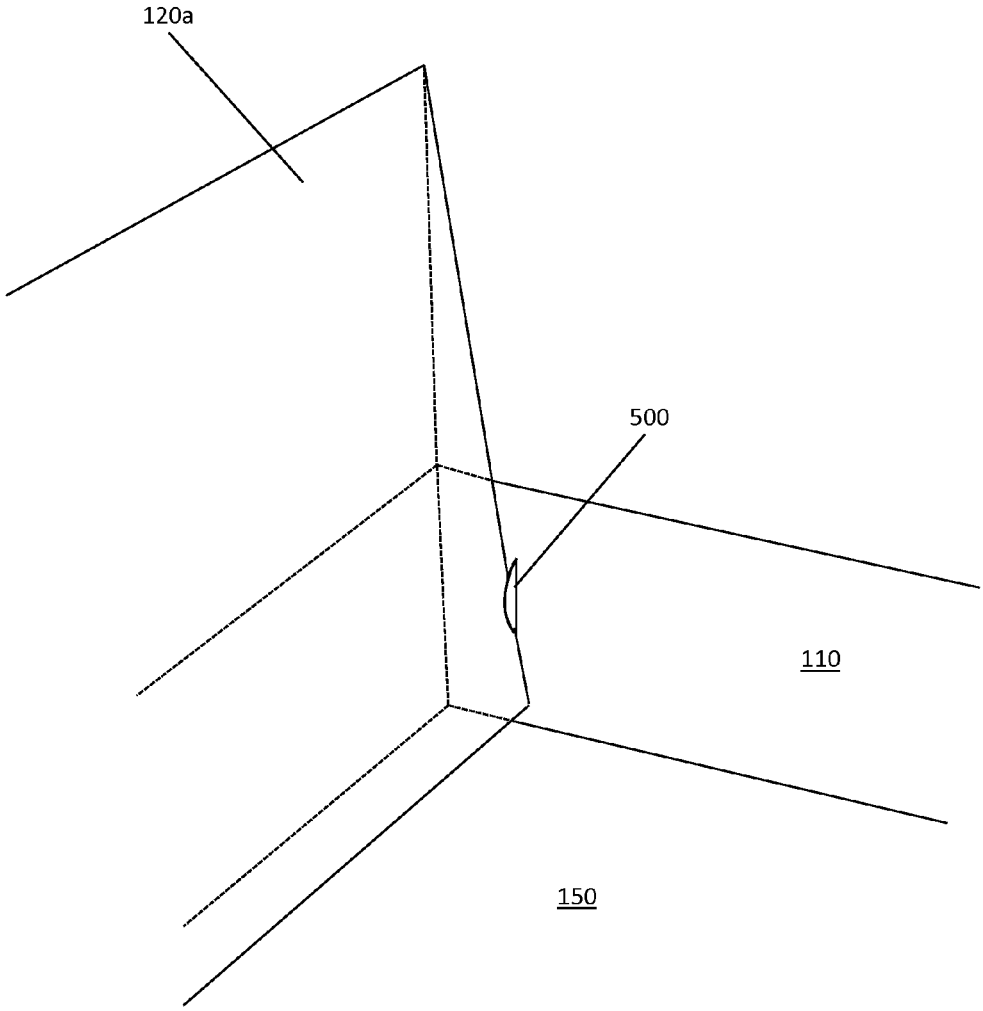
FIG. 4 is a close-up perspective view of an embodiment having a pop-out tab as viewed from the interior of the container.
Figure 5:
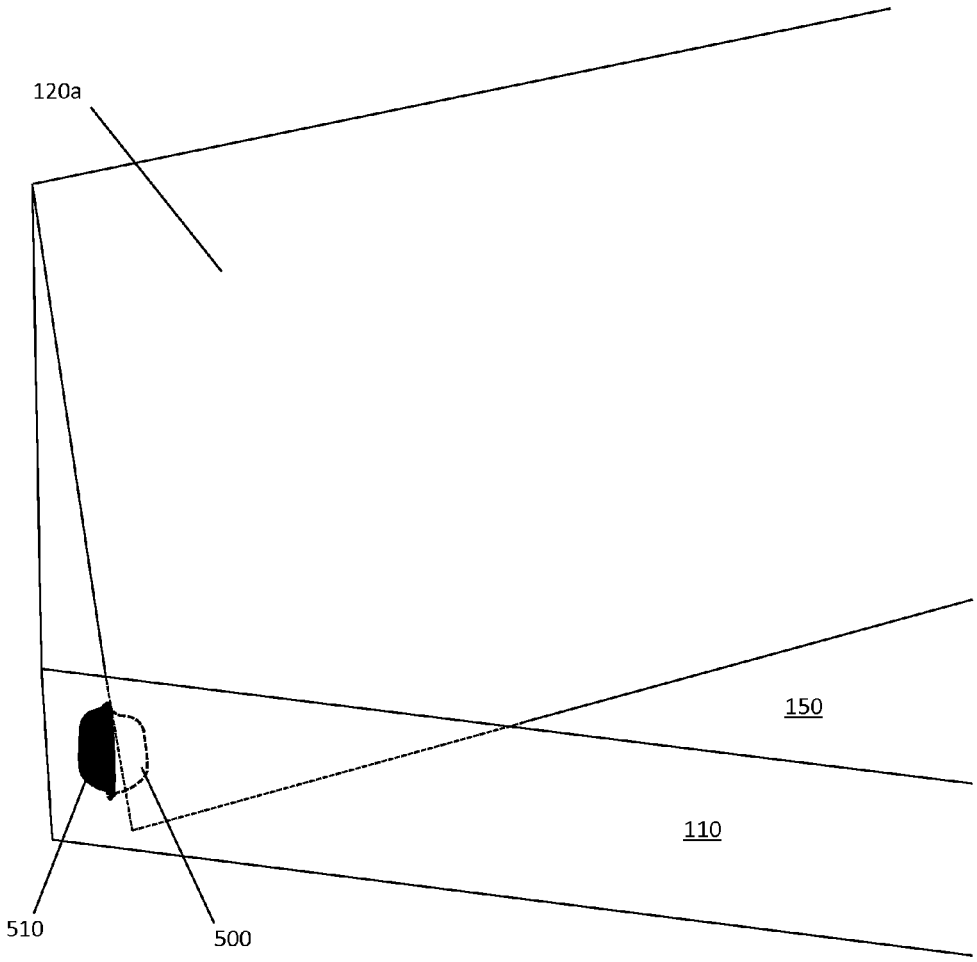
FIG. 5 is a close-up view of the embodiment of FIG. 4 shown from the exterior of the container.

Embodiments may employ means for retaining the leaves 120*a*, 120*b* in a folded configuration which differ from the system of tabs 124*a*, 124*b* and slots 140*a*, 140*b* described above. For instance, and without limitation, FIGS. 4 and 5 illustrate an embodiment having a pop-out tab 500 formed into the box 110. FIG. 4 is a view of the interior of an embodiment showing a wall of the box 110 with a tab 500 retaining a folded leaf 120*a*. The same embodiment is shown from the outside in FIG. 5, wherein the tab 500 is shown in dotted line extending into the box behind wall 110. Also shown is the negative space 510 left by the pop-out tab 500. Such a tab may be formed, for instance, by perforating box wall 110 thereby allowing an end user to form the tab by applying pressure to the perforated region thereby popping out the tab 500. One skilled in the art will appreciate that a number of other means for retaining a folded leaf may be employed, including various outcroppings on the interior of the box. Suitable outcroppings may be formed from the box material or may be added to the box, e.g. an adhesively attached outcropping.

Figure 6:
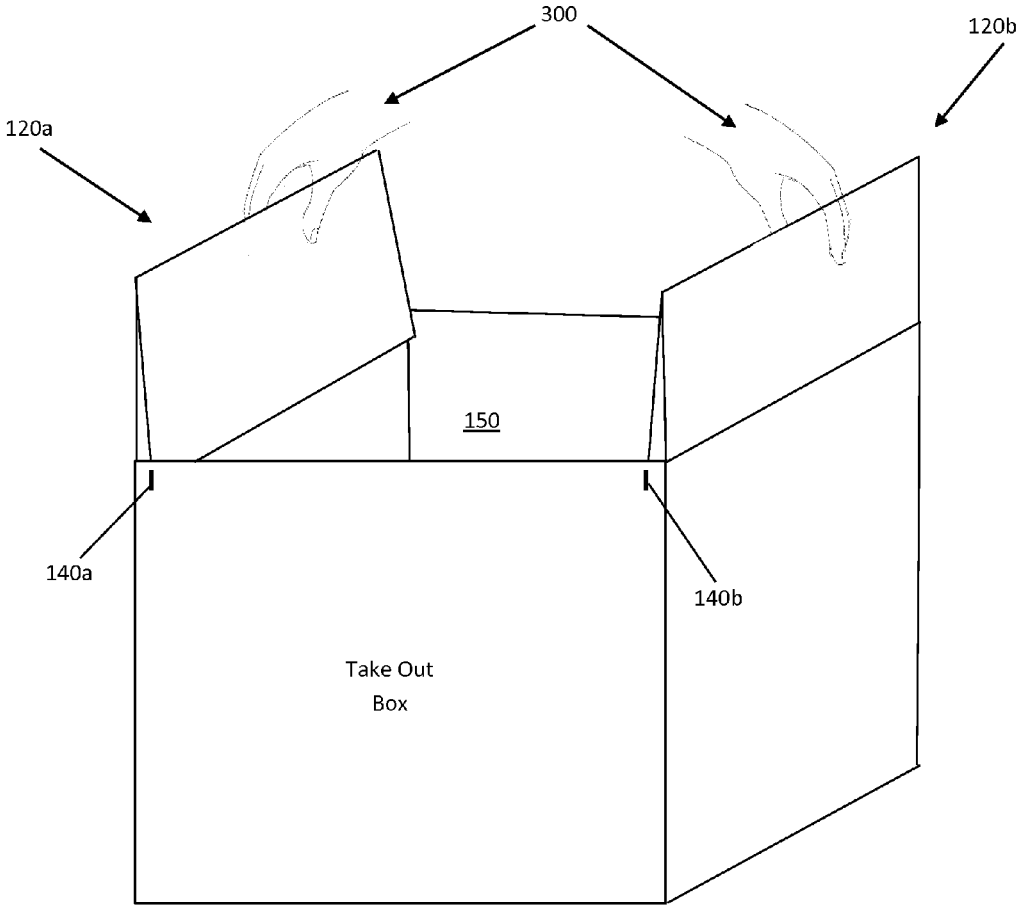
FIG. 6 is perspective view of an embodiment having an alternative form factor.

FIG. 6 is a perspective view of an embodiment having an alternative form factor. The illustrated embodiment is deeper than the previously illustrated embodiments, and may be suitable for containing items such as pastas, salads, or soups. One skilled in the art will appreciate that the present invention is not limited by overall shape or form factor and that embodiments may take on any of a wide variety of form factors.

Figure 7:
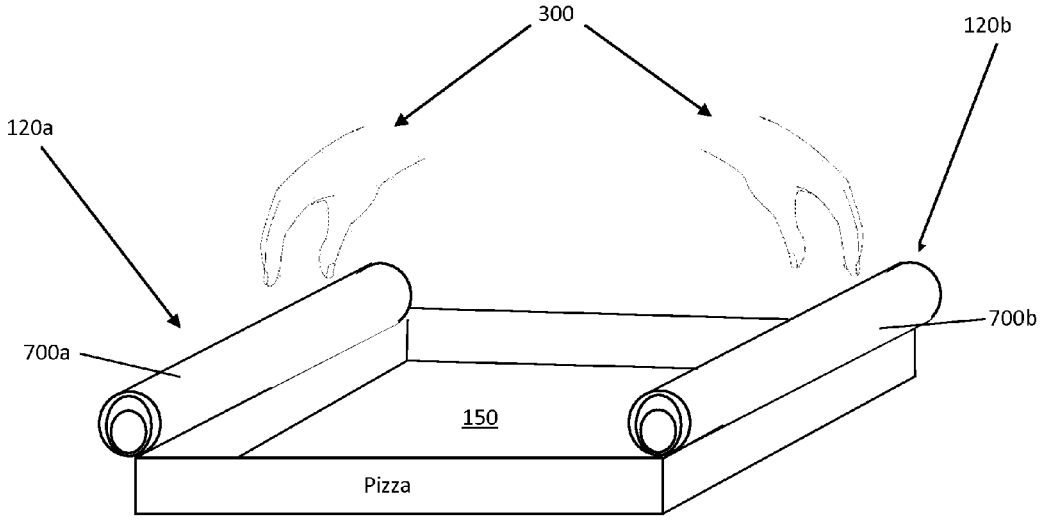
FIG. 7 is a view of an embodiment having roll-up lid leaves.

FIG. 7 illustrates an alternative embodiment wherein the leaves 120*a*, 120*b* are rolled rather than folded. Similar to other embodiments described herein, a rolled-leaf embodiment may include structure for retaining the leaves in a rolled configuration. For example, a rolled leaf may be held in place by a built-in bias toward a rolled configuration the means for creating such a bias being known to those skilled in the art. Other variations on a rolled embodiment may include tabs, folds, pop-outs or any of a wide variety of structures known to those skilled in the art for retaining parts of a storage container or box in a desired configuration. Also shown in FIG. 7 is a pair of hands reaching for handles 700*a*, 700*b* formed by the rolled leaves 120*a*, 120*b*.

Figure 8A:
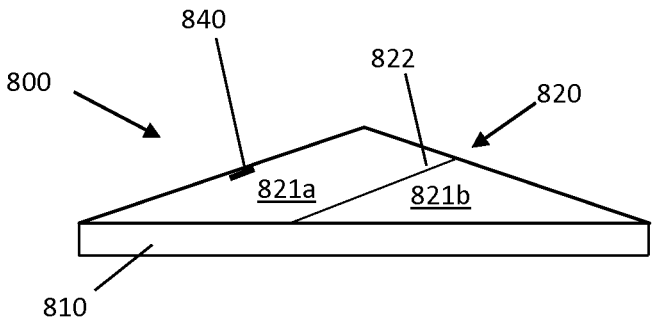
FIG. 8A is a perspective view of a three-sided embodiment in a closed configuration.
Figure 8B:
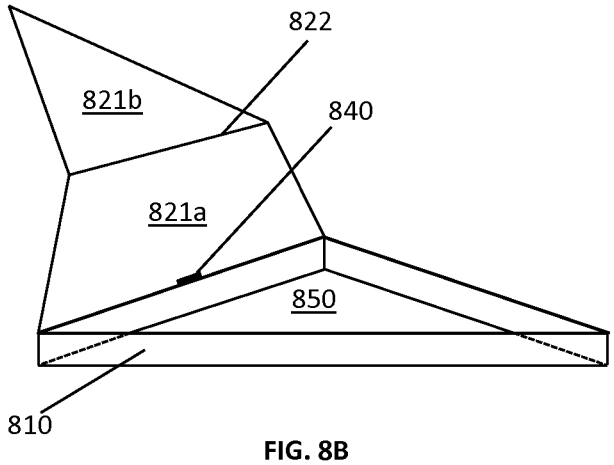
FIG. 8B is a perspective view of the embodiment of FIG. 8A in a partially closed configuration.
Figure 8C:
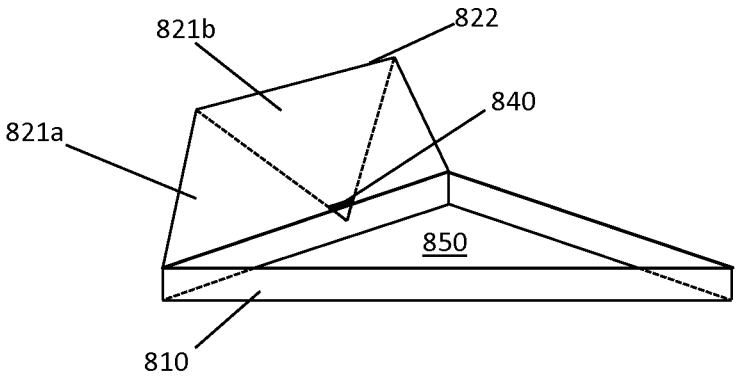
FIG. 8C is a perspective view of the embodiment of FIG. 8B in a fully opened configuration.

FIGS. 8A, 8B, and 8C illustrate a single-slice pizza box embodiment 800. The illustrated embodiment 800 includes a set of three sidewalls 810 and a single-leaf lid 820 divided along a fold line 822 into two panels 821*a*, 821*b*. The trapezoidal panel 821*a* includes a slot 840 in or near the line where the trapezoidal panel 821*a* joins to the rear sidewall 810. Accordingly, the lid 820 can be folded back as shown in FIG. 8B, and the tip of the triangular panel 821*b* can be inserted into the slot 840 as shown in FIG. 8C. Accordingly, the box has the same space-saving effect as other embodiments described herein, and functions both as a delivery box and a serving container wherein a food product may be placed on the interior surface 850. Furthermore, the lid 820 may function as a handle when it is in the folded configuration shown in FIG. 8C.

Embodiments of the invention are not limited to the particular containers described herein. Rather, embodiments may find application in any of a wide variety of food containers including, without limitation both disposable and reusable containers. A reusable embodiment may comprise, for instance, one or more of a storage container for bulk food, a storage container for pre-portioned individual meals, a baking dish, or a casserole dish. Disposable embodiments may include, without limitation, boxes for packaging take-out foods. A reusable embodiment may be advantageously constructed from a durable polymer such as a polyolefin blend, whereas a disposable embodiment may be constructed from an inexpensive paper board or corrugated cardboard which may include interior linings adapted to retain heat and/or moisture.

It will be apparent to those skilled in the art that the above methods and apparatuses may be changed or modified without departing from the general scope of the invention. The invention is intended to include all such modifications and alterations insofar as they come within the scope of the appended claims or the equivalents thereof.

We claim:

1. A food container, comprising:

at least three sidewalls each adjoining an edge of a base wall bounded by at least three edges; and a lid comprising a pair of leaves adjoined to opposing sidewalls of the container and adapted to substantially meet along a center line of the container when the lid is in a closed configuration, wherein each of the two leaves are foldable along pre-formed center fold lines of the respective leaves to form a pair of upright handles at opposing sidewalls, and wherein each leaf of the pair of leaves is retained in a folded configuration above a top edge of the sidewalls by a slot having a continuous unbroken perimeter formed in a sidewall of the container adjacent to the sidewall to which the corresponding leaf is adjoined, and a tab formed on a side-facing edge of the corresponding leaf, wherein the slot cooperates with the tab to retain the corresponding leaf in the folded configuration.

2. The container of claim 1, comprising four sidewalls, and further comprising a lid having two leaves attached to opposing sidewalls and adapted to substantially meet along a center line of the container when the lid is in a closed configuration.

3. The container of claim 2, wherein each of the two leaves are foldable along pre-formed center fold lines of the respective leaves, each leaf being divided into a pair of panels hingedly joined at the pre-formed fold lines.

4. The container of claim 3, further comprising means for retaining each of the two leaves in a folded configuration, wherein the folded configuration corresponds to an open configuration of the container.

5. A food container, comprising:

at least four sidewalls each adjoining an edge of a base wall bounded by a corresponding number of edges; and a lid comprising a pair of leaves adjoined to opposing sidewalls of the container and adapted to substantially meet along a center line of the container when the lid is in a closed configuration, wherein each of the two leaves are foldable along pre-formed center fold lines of the respective leaves to form a pair of upright handles at opposing sidewalls, and wherein each leaf of the pair of leaves is retained in a folded configuration by a slot having a continuous unbroken perimeter formed in a sidewall of the container adjacent to the sidewall to which the corresponding leaf is adjoined, and a tab formed on a side-facing edge of the corresponding leaf, wherein the slot cooperates with the tab to retain the corresponding leaf in the folded configuration.

6. The container of claim 5, wherein the leaves are adapted to function as handles when the leaves are retained in the folded configuration.

7. A food container, comprising:

at least three sidewalls each adjoining an edge of a base wall bounded by at least three edges, wherein the at least three sidewalls are constructed from a material selected from one or more of card board or corrugated card board;

a lid comprising a pair of leaves adjoined to opposing sidewalls of the container and adapted to substantially meet along a center line of the container when the lid is in a closed configuration, wherein each of the two leaves are foldable along pre-formed center fold lines of the respective leaves to form a pair of upright handles at opposing sidewalls, and wherein each leaf of the pair of leaves is retained in a folded configuration above a top edge of the sidewalls by a slot having a continuous unbroken perimeter formed in a sidewall of the container adjacent to the sidewall to which the corresponding leaf is adjoined, and a tab formed on a side-facing edge of the corresponding leaf, wherein the slot cooperates with the tab to retain the corresponding leaf in the folded configuration; and a lining bonded to an interior surface of the at least three sidewalls and the at least one lid, the lining comprising one or more of a waterproofing layer, or an insulating layer.

8. The container of claim 7, comprising four sidewalls.

9. The container of claim 8, wherein each of the two leaves is divided into a pair of panels hingedly joined at the pre-formed fold lines.

10. The container of claim 9, wherein the folded configuration corresponds to an open configuration of the container.

* * * * *